US005278570A

United States Patent [19]

Jaramillo et al.

[11] Patent Number: 5,278,570

[45] Date of Patent: Jan. 11, 1994

[54] COMBINED COAXIAL CONNECTOR AND RADIO FREQUENCY SWITCH ASSEMBLY

[75] Inventors: Giovanni Jaramillo, Plantation; Lawrence J. Pulliam, Pompano Beach, both of Fla.; See N. Kok, Penang, Malaysia

[73] Assignee: Motorola, Inc., Schaumburg, Ill.

[21] Appl. No.: 941,602

[22] Filed: Sep. 8, 1992

[51] Int. Cl.[5] ..... H01Q 1/24

[52] U.S. Cl. ..... 343/702; 343/906; 439/916

[58] Field of Search ..... 343/702, 906, 872; 439/582, 578, 63, 188, 916; 174/153 A, 152 A; H01Q 1/24

[56] References Cited

U.S. PATENT DOCUMENTS

| | | | |
|---|---|---|---|
| 3,946,390 | 3/1976 | Alexander et al. | 343/702 |
| 4,611,213 | 9/1986 | Johnson et al. | 343/906 |
| 4,892,491 | 1/1990 | Budano, II et al. | 439/582 |
| 4,895,324 | 1/1990 | Buckles | 246/170 |
| 5,079,558 | 1/1992 | Koike | 343/702 |
| 5,121,504 | 6/1992 | Toko | 455/90 |
| 5,145,382 | 9/1992 | Dickirson | 439/63 |

*Primary Examiner*—Michael C. Wimer
*Assistant Examiner*—Tan Ho
*Attorney, Agent, or Firm*—Juliana Agon

[57] ABSTRACT

An antenna connector and RF switch assembly (10) is provided on a portable radio (14). The radio includes a self-contained antenna (16) and a radio circuit (27). The assembly (10) is used for selectively connecting the radio circuit (27) to the antenna (16) or to an external signal supply (39). In the assembly, a switchable conductive center contact portion (22, 20, 35) selectively engages either the antenna (16) or the external signal supply (39). A metallic housing (18), having an antenna bushing (17), receives the antenna (16). A molded dielectric insulator portion (26) separates the switchable conductive center contact portion from the metallic housing and is directly connected to the antenna bushing.

10 Claims, 3 Drawing Sheets

COMBINED COAXIAL CONNECTOR AND RADIO FREQUENCY SWITCH ASSEMBLY

TECHNICAL FIELD

This invention relates generally to coaxial connectors and particularly to coaxial connectors having spring molded contacts for radio frequency switching.

BACKGROUND

It is known in portable radios to provide a receptacle on the radio housing for switchable connection of an integral antenna or external circuits from a remote antenna, to the radio. Such a receptacle connector is described in U.S. Pat. No. 3,946,390. A soldered pigtail connects that receptacle connector to a coaxial connector of the integral antenna. Coaxial connectors are generally used for providing impedance matched and shielded radio frequency (RF) connections. To reduce parts and labor, there exists a need to provide a solderless combination of a coaxial connector and an RF switch in the same device.

SUMMARY OF THE INVENTION

Briefly, according to the invention, an antenna connector and RF switch assembly is provided on a portable radio. The radio includes a self-contained antenna and a radio circuit. The assembly is used for selectively connecting the radio circuit to the antenna or to an external signal supply. In the assembly, a switchable conductive center contact portion selectively engages either the antenna or the external signal supply. A metallic housing, having an antenna bushing, receives the antenna. A molded dielectric insulator portion separates the switchable conductive center contact portion from the metallic housing and is directly connected to the antenna bushing.

In one aspect of the invention, a first contact of the assembly is connected to the antenna. A second contact is also present within the assembly for providing connection to the external signal supply. A flexible contact is connected to the radio circuit and, normally, is in engagement with the first contact. However, the flexible contact is capable of being flexed away from the first contact to engage with the second contact. A non conductive plunger, normally in a first position spaced from the second contact, is movable to a second position for engagement with the flexible contact and for flexing the flexible contact away from the first contact to engage with the second contact. A dielectric housing is spaced about, but having dielectric openings for, the contacts and the non-conductive plunger. An antenna bushing is directly connected to the dielectric housing and surrounds the first contact. A metallic housing is about the dielectric housing. The metallic housing has an aperture for protruding the antenna bushing through it and corresponding metallic openings corresponding to the dielectric openings, to form a radio frequency (RF) coaxial connector, whereby the frequency coaxial connector normally provides an RF conducting path from the first contact to the flexible contact to connect the antenna to the radio circuit.

DETAILED DESCRIPTION OF THE PREFERRED EMBODIMENT

Figure 1:
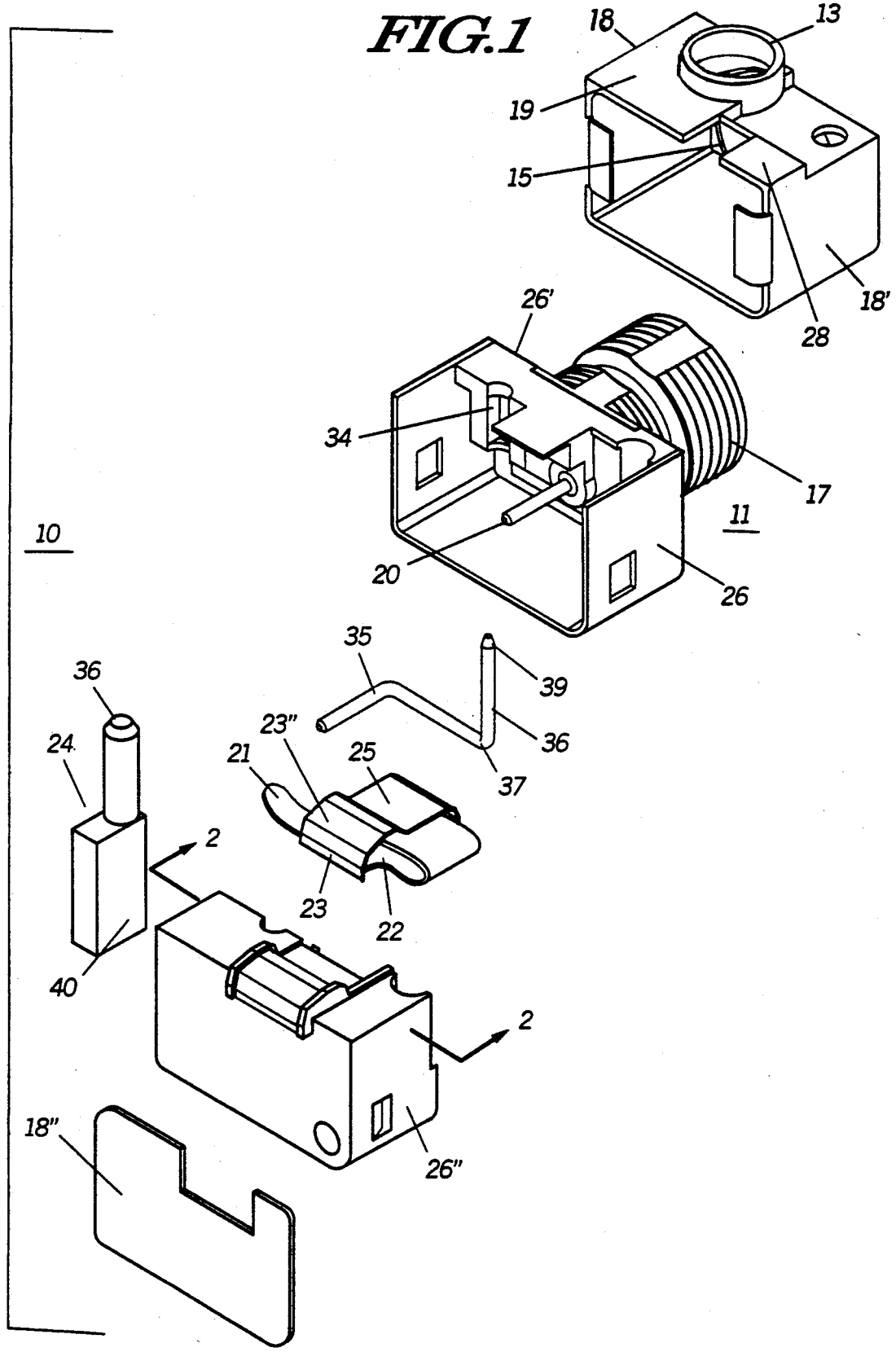
FIG. 1 shows a connector in accordance with the present invention.
Figure 3:
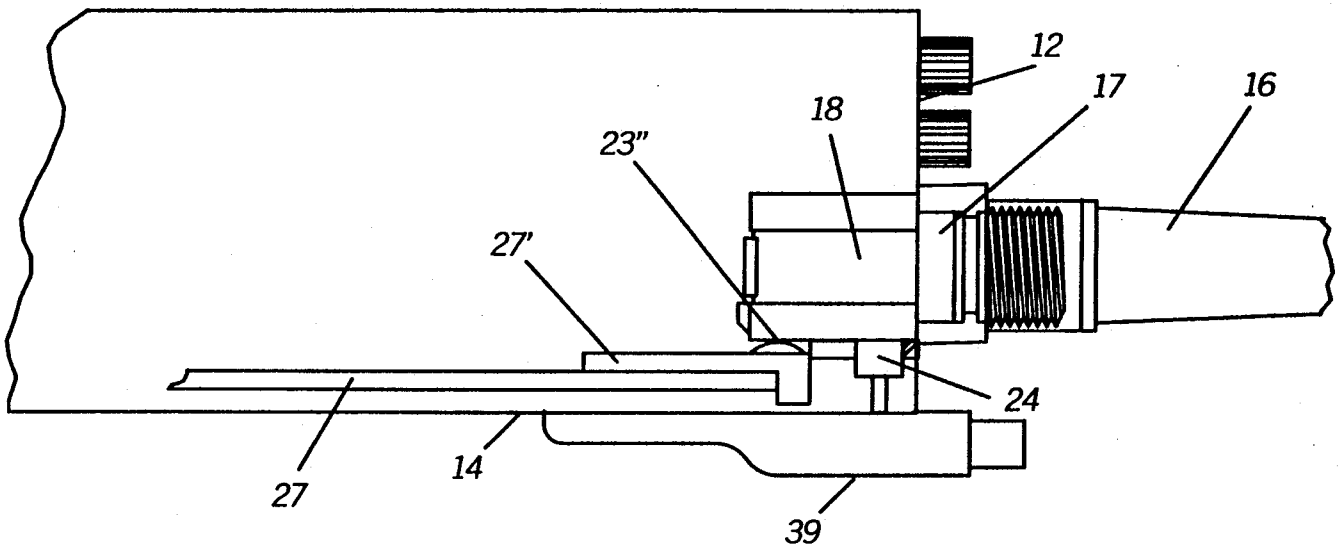
FIG. 3 shows a simplified representation of the completely assembled connector of FIG. 1.

Referring to FIGS. 1 and 3, there is shown a receptacle connector 10, as used in a portable radio device such as a handheld radio transmitter and receiver radio housing 14 which includes an antenna 16. The connector 10 has a metallic housing 18 which forms an RF shielded enclosure, when the top shield 18' and the bottom plate 18" of the metallic housing 18 are sealed. The top shield 18" is preferably made from a zinc-alloy called ZAMAK or ZDC-2 and plated with nickel to provide a good electromagnetic shield.

On top of the top shield 18' is an aperture 15 for receiving an antenna bushing 17, attached as part of the connector 10. The material of the antenna bushing 17 is preferably made from stainless steel. As seen in FIG. 3, the connector 10 is mounted on a wall 12 of the radio housing 14. The antenna 16 is also secured to the radio housing 14, by way of the antenna bushing 17, connecting the ground of the antenna 16 to the ground of the connector 10, provided by the metallic housing 18.

A resilient contact 22, preferably comprising a cantilevered spring, includes a spring end 21 and a support base 25. The resilient movable contact 22 has a "U" shaped turn, capable of being horizontally flexed, at the end 21 of the resilient spring contact 22, away from a stable support formed by a relatively vertical cantilevered support base portion 25, having a side contact 23" and a base contact 23.

Figure 4:
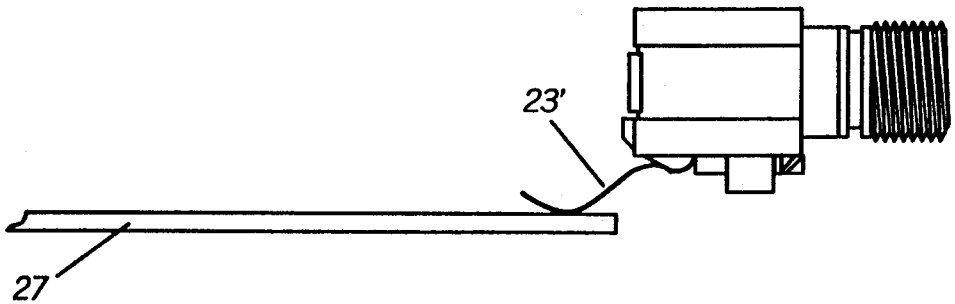
FIG. 4 shows an alternate embodiment of the assembled connector in accordance with the present invention.

The support base 25 includes the side contact 23" for flush engagement with an RF contact pad of a printed circuit board (PCB) 27, or of a printed circuit board extension 27' (as shown in FIG. 4) having suitable contacts (not shown) for connecting with the RF circuit of PCB 27. Because of the substantially flat side plate 19 of the metallic housing 18 and the relatively flat RF side contact 23" of the resilient movable contact 22, the receptacle connector 10 can interface to the radio printed circuit board extension 27' using only pressure mating of the contact 22 and side plate 19 to the corresponding contacts of the board extension 27', without the need for soldering.

Optionally, the printed circuit board extension 27' can be eliminated by changing the base contact to one having a protruded tail 23' for direct engagement with the printed circuit board 27. A similar protruded tail forms a ground contact, next to the signal contact 23', for directly grounding to the printed circuit board 27.

The spring end 21 normally connects the RF circuit with a center contact pin of the connector 10. The center contact pin, providing a first antenna post 20, is preferably made from beryllium copper and gold plated over nickel. Together with the antenna bushing 17, the first antenna post 20, held together and separated by a dielectric housing 26, forms a coaxial connector for the antenna 16.

Secured within the metallic housing 18 of the receptacle connector 10, is the non-conductive dielectric housing 26, which is preferably made from a dielectric moldable, and high temperature plastic such as polyethimide. ULTEM TM is a trademark of the General Electric Corporation for the polyethimide. The dielectric housing 26 comprises a top dielectric cover 26' and a base dielectric cover 26''.

The first antenna post 20 can be embedded within the top dielectric cover 26' and surrounded by the antenna busing 17 attached to the top of the top cover 26', using insert molded manufacturing techniques. (The antenna bushing 17, along with the concentric first antenna post 20, is insert molded together with the dielectric top cover 26' as one unit 11.) The insert molded unit 11 is later assembled with the metallic housing 18, in which the antenna bushing 17 protrudes from the opening 15 in the metallic housing 18. The metallic housing 18, enclosing the entire dielectric cover 26, includes a substantially flat protruding portion 28 for connecting the connector 10 to the ground of the printed circuit board via the extension 27'. Due to the relatively large area of the ground contact 18' of the side plate 19, improved electromagnetic shielding is provided for the antenna.

The dielectric housing 26, containing various inner contours, isolates and covers substantially everything within the metallic housing 18, except for a non-conductive plunger 24, a pointed end 39 for connecting with a remote second antenna, and the side fixed RF contact 23'' (or alternatively, the protruded tail 23') which are all accessible through appropriate openings 13 in the metallic housing 18 and in the dielectric housing 26.

The plunger 24 is slideably supported and positioned within a channel 34 of the dielectric housing 26. The non-conductive plunger 24 preferably made from a plastic material, such as acetyl. DELRIN TM is an acetyl manufactured by Dupont. The plunger 24 is mounted, within the channel 34, for engagement with the resilient contact 22. The plunger 24 has an enlarged actuating end 40 which engages the spring end 21 of the resilient contact 22. In its normal position, the actuating end 40 is not exerting any force upon the contact 22. Without exerted pressure, the contact 22 engages the center first antenna post 20 to provide an RF circuit connection, such as shown in the solid line connection in FIG. 2.

Figure 2:
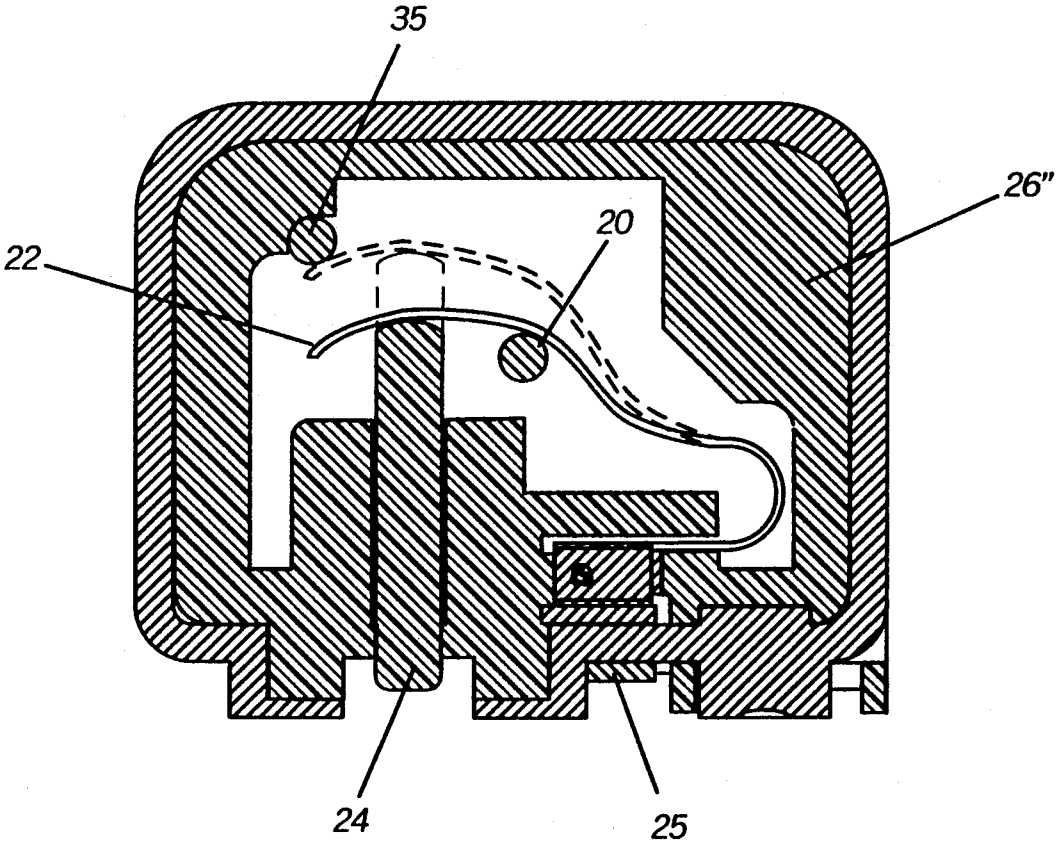
FIG. 2 shows a simplified top cross-sectional view of the connector of FIG. 1.

Referring to FIGS. 1 and 2, when a head 36 of the plunger 24 is moved inwards, by attachment of remote accessories, such as a remote antenna, to the radio, the actuating end 40 pushes the spring end 21 of the resilient contact 22 away from the first antenna post 20. In this way, the connection between the contact 22 and the first antenna post 20 is broken.

The spring end 21 is then moved towards a second antenna post 35 of a tri-axial "Z" shaped wire 36 to make electrical connection between the second antenna post 35 and the side RF fixed contact 23''. Alternatively, the connection is made with the protruded tail 23' instead of with the side contact 23'', as seen in FIG. 4.

The second antenna post 35 forms one end of the tri-axial substantially "Z" shaped wire 36 having three straight portions and two substantially 90° turns. Thus, the resilient contact 22 is open-circuited from the first antenna post 20. However, (as shown by the dashed lines of FIG. 2), the resilient contact 22 is close-circuited to the second antenna post 35, for connection of the RF circuit to the external signal source. The external signal source is now accessible by the pointed end 39 of an "L" shaped bend 37 of the tri-axial pin 36.

Since the antenna bushing 17 is insert molded with the dielectric top cover 26' and the first antenna post 20, a good coaxial electrical connection is made which continues within the dielectric cover 26, shielded by the metallic housing 18. This combination of dielectric and metal surrounding the first antenna post 20 provides a coaxial conducting line which forms a matched connection. This substantially matched connection help prevent impedance discontinuity which would cause a loss in signal strength or distortion of the signal. The coaxial connector formed by the antenna bushing 17, insert molded with the centered first antenna post 20, rigidly attached by the insert molding process with the dielectric material Ultem, thus provides a good electromagnetic shielded connection which also mechanically retains the antenna of the radio. At the same time, the device of the present invention will switch the internal RF connection from the antenna of the radio device to the remote antenna, by mechanical actuation of an external plunging mechanism (not shown) for applying an actuating force upon the plunger 24. Due to the insert molding of the dielectric material Ultem, surrounding the area between the antenna bushing 17 and the protruding first antenna post 20, on the top surface of the top dielectric cover 26', the antenna bushing 17 is submersible in water. Thus, no additional washer or "O" ring is necessary, as usually found between the antenna bushing and the radio housing.

What is claimed is:

1. An antenna connector and RF switch assembly in a portable radio, the radio having a self-contained antenna and a radio circuit, the assembly for selectively connecting the radio circuit to the antenna or to an external signal supply, the assembly comprising:

a first contact connected to the self-contained antenna;

a switchable conductive center contact portion having a support base and a flexible contact for selectively engaging either the antenna or the external signal supply, the support base coupled to the radio circuit and the flexible contact normally in engagement with the first contact and capable of being flexed away from the first contact;

a second contact for connection to the external signal supply;

a non-conductive plunge normally biased in a first position, spaced from the second contact, and movable to a second position for engaging the flexible contact and for flexing the flexible contact away from the first contact to engage with the second contact;

a metallic housing having an antenna bushing concentrically located about the first contact, the antenna bushing for receiving the antenna; and a molded insulator portion separating the switchable conductive center contact portion and the second contact from the metallic housing and is directly connected to the antenna bushing and the first contact to form a receptacle for the self-contained antenna.

2. The assembly of claim 1, wherein the molded insulator portion comprises a dielectric housing spaced about, and having dielectric openings for, the contacts and the non-conductive plunger.

3. The assembly of claim 1, wherein the antenna bushing surrounds the first contact.

4. The assembly of claim 3, wherein the metallic housing surrounds the dielectric housing, the metallic housing having an aperture, for protruding the antenna busing through the aperture, and corresponding metallic openings corresponding to the dielectric openings, to form the receptacle for the antenna, the receptacle being a radio frequency (RF) coaxial connector, whereby the radio frequency coaxial connector normally provides an RF conducting path from the first contact to the flexible contact to connect the antenna to the radio circuit.

5. The assembly of claim 1, wherein the molded insulator portion is made from polyethimide.

6. The assembly of claim 1, wherein the non-conductive plunger is made from acetyl.

7. A combined coaxial connector and RF switch assembly for interconnecting a printed circuit surface to either an antenna or to an external signal supply, the assembly comprising:

a first contact connected to the antenna;

a switchable conductive center contact portion having a support base and a flexible contact for selectively engaging either the antenna or the external signal supply, the support base mountable with an external signal supply contact pad of the printed circuit surface and the flexible contact normally in engagement with the first contact and capable of being flexed away from the first contact;

a second contact for connection to the external signal supply;

a non-conductive plunger normally biased in a first position, spaced from the second contact, and movable to a second position for engaging the flexible contact and for flexing the flexible contact away from the first contact to engage with the second contact;

a metallic housing for receiving the antenna and surface mounting with the printed circuit surface as a ground contact; and a molded dielectric insulator portion separating the switchable conductive center contact portion, the second contact, and the metallic housing, wherein the portions and the metallic housing form a single modular piece.

8. The assembly of claim 7, further comprising:

the ground contact of the metallic housing forming a bottom surface of the single modular piece;

the metallic housing having a top surface of the single modular piece, the top surface having an antenna receptacle for receiving the antenna;

and the metallic housing having a side surface for coupling with the external signal supply, wherein the bottom, top, and side surfaces are all perpendicular to each other.

9. A combined coaxial connector and RF switch device for interconnecting a printed circuit surface to either an antenna assembly or to an external signal supply, the device comprising:

an insert-molded dielectric top cover having a conductive center contact pin for engaging the antenna of the antenna assembly, and a ground conductor portion for receiving the antenna assembly and for engaging the ground of the antenna assembly, the ground conductor portion being concentric with the conductive center contact pin;

a switchable center contact assembly selectively engaging the printed circuit surface with either the contact pin or the external signal supply;

a molded dielectric bottom cover for housing the switchable center contact assembly and for mating with the top cover; and a metallic housing for housing the covers and for mounting with the printed circuit surface.

10. The device of claim 9, wherein the switchable center contact assembly comprises:

a tri-axial pin having first, second, and third straight portions connected by two substantially 90 degree turns to approximate a three-dimensional "Z" shape for contacting the external signal supply at the first straight portion and the third straight portion being normally free;

a cantilevered spring having a spring end and a support end, the support end for contacting the printed circuit surface, the spring end normally contacting the center contact pin; and a non-conductive plunger for moving the spring end of the cantilever spring away from the center contact pin and towards the third straight portion of the tri-axial pin for engagement therewith.

* * * * *